United States Patent [19]

Tetzner

[11] 4,369,614

[45] Jan. 25, 1983

[54] WRAPPING APPARATUS

[76] Inventor: Siegfried K. Tetzner, 5307 W. Lake Shore Dr., Wonder Lake, Ill. 60097

[21] Appl. No.: 207,788

[22] Filed: Nov. 17, 1980

[51] Int. Cl.[3] ..... B65B 11/02; B65B 13/04

[52] U.S. Cl. ..... 53/556; 53/588; 53/390

[58] Field of Search ..... 53/339, 390, 441, 556, 53/587, 588, 211; 242/55.54, 68.3, 75.4

[56] References Cited

U.S. PATENT DOCUMENTS

| | | | |
|---|---|---|---|
| 802,145 | 10/1905 | Hill | 242/55.54 |
| 4,067,174 | 1/1978 | Goldstein | 53/556 |
| 4,077,179 | 3/1978 | Lancaster | 53/211 |
| 4,102,513 | 7/1978 | Guard | 53/399 |
| 4,152,879 | 5/1979 | Shulman | 53/587 X |
| 4,166,348 | 9/1979 | Carlson | 53/588 X |
| 4,166,589 | 9/1979 | Hoover | 53/441 |

FOREIGN PATENT DOCUMENTS

| | | | |
|---|---|---|---|
| 2810124 | 9/1978 | Fed. Rep. of Germany | 53/210 |

*Primary Examiner*—John Sipos

*Attorney, Agent, or Firm*—Wegner, McCord, Wood & Dalton

[57] ABSTRACT

An apparatus for wrapping a load carried on a floor-mounted pallet. The apparatus includes a carriage having a wheeled base for rolling movement about the pallet-carried load. The carriage is provded with an upright upstanding from the base and vertically movably supporting a carrier for a roll of wrapping sheet material. A handle structure is provided on the carriage for manipulation of the carriage in effecting the rolling movement about the pallet-carried load and mechanism is provided adjacent the handle for effecting vertical movement of the carrier to permit spiral wrapping of the sheet material about the pallet-carried load. The carrier is arranged to extend downwardly to a lowermost position, permitting wrapping of the pallet substantially at floor level and, in an uppermost position, for wrapping the uppermost portion of the load. The invention further includes improved structure for releasably retaining the sheet material roll on a spindle on the carrier.

10 Claims, 2 Drawing Figures

10
14
S
52
23
13
19
11
15
L
16
P 33
11
12
10
58
56
51
57
59
30
60
44
42
40
41
43
37
35
46
39
45
38
36
47
48
34
52
53
55
54

26
27
29
23
50
32
61
28
20
49
31
25
62
24
15
19
22
18
16
21
17

WRAPPING APPARATUS

BACKGROUND OF THE INVENTION

1. Field of the Invention

This invention relates to wrapping apparatus and in particular to apparatus for wrapping sheet material, such as synthetic resin film, netting, etc., about a load carried on a pallet.

2. Description of the Background Art

In the stretch wrapping of loads carried on pallets, synthetic resin sheet material is spirally wrapped about the load on the pallet. One such wrapping apparatus comprises a portable unit wherein the roll of sheet material is carried on a spindle mounted on a handle. A control knob is mounted to the spindle for adjusting the tension on the roll, thus permitting the user to walk around the load while the film is withdrawn under tension in being wrapped about the load.

In another form of prior art load wrapping apparatus, a roll having an axial length substantially the height of the load to be wrapped is carried on a wheeled support, permitting the support to be rolled about the load with the sheet wrapping the load upon completion of one movement about the load. With such a load wrapping means, the load is conventionally wrapped a number of times so as to provide a double or triple wrap about the load.

In another form of wrapping apparatus, a turntable is provided on which the pallet is placed, with the wrapping apparatus disposed adjacent the turntable. Upon revolution of the turntable, the load is wrapped with the roll being retained in a fixed position as the sheet is withdrawn therefrom. Such a turntable may also be utilized with the handwrapping mechanism which can be held in a single position as the turntable rotates the load therepast.

SUMMARY OF THE INVENTION

The present invention comprehends an improved apparatus for wrapping a load on a floor-carried pallet wherein a relatively short length roll, such as a roll of 20-inch length, is vertically adjustably positioned as the roll is moved about the pallet-carried load on a wheeled carriage so as to spirally wrap the load efficiently and at low cost.

The apparatus is arranged to dispose the film roll in a lowermost position wherein the lower edge of the film is substantially at floor level so as to permit wrapping of the pallet also to substantially floor level and thereby permit wrapping of the entire pallet-carried load with the desired spiral film wrap. Alternatively, the wrapping may be effected of only the load on the pallet, or any portion of the load on the pallet, as desired.

The carriage on which the film roll is rotatably carried is provided with a handle for facilitated rolling movement thereof about the load in the spiral wrapping of the film thereabout.

Means for controlledly moving the roll axially during the spiral wrapping operation includes manually operable means adjacent the carriage handle, permitting facilitated concurrent movement of the carriage and movement of the roll on the carriage in effecting the wrapping operation.

In the illustrated embodiment, the means for moving the roll axially comprises mechanically operable means.

The spindle means for mounting the film roll rotatably to the carriage is provided with improved means for selectively retaining the roll thereon, permitting facilitated installation and removal of the roll as desired.

The roll retaining means includes manually operable means at the upper end of the spindle of simple and novel construction.

The retaining means includes a retaining cap which may be adjustably urged against the upper end of the roll to provide desired tension in the wrapping operation.

The cap is adapted to be installed by lateral movement about the securing means. Upon removal of the cap, the roll is installable and removable relative to the spindle by movement coaxially about the securing means.

The apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2:
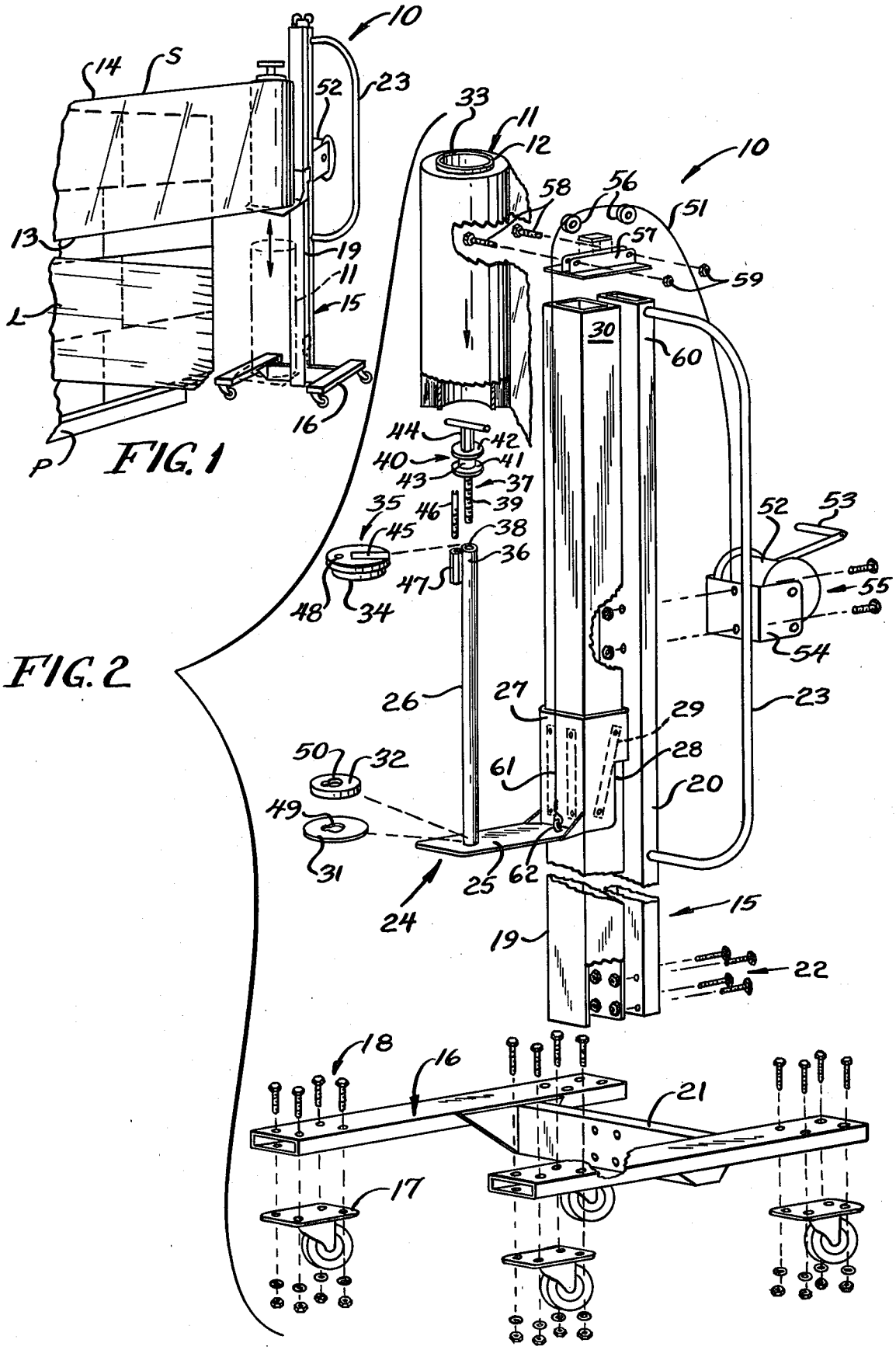
FIG. 1 is a fragmentary perspective view illustrating the use of the wrapping apparatus in wrapping a pallet-carried load.
FIG. 2 is an exploded perspective view of the apparatus.

In the exemplary embodiment of the invention as disclosed in the drawing, an apparatus generally designated 10 is provided for spirally wrapping a sheet S of synthetic resin material about a load L carried on a floor-mounted pallet P. The sheet material is provided in the form of a film roll 11 having a core 12. In the illustrated embodiment, the film comprises a transparent synthetic resin having a roll length of approximately 20 inches, and a roll diameter of approximately 9¼ inches, such dimensions being exemplary only.

As seen in FIG. 1, the load L is wrapped by moving the carriage 15 about the load carried on the pallet P so as to provide a spiral wrapping of the sheet S thereabout. Apparatus 10 is arranged to permit the lower edge 13 of the sheet to be disposed substantially at the floor level at the lowermost position of the roll 11, as shown in dotted lines in FIG. 1, and with the upper edge 14 of the sheet at the upper level of the load so as to permit a complete wrapping of the pallet and load in the manner illustrated in FIG. 1.

The wrapping apparatus includes the carriage generally designated 15 having a wheeled base 16 for rolling movement of the carriage on the floor about the pallet-carried load. As seen in FIG. 2, base 16 is provided with a plurality of casters 17 removably secured thereto by suitable nut and bolt means 18.

The carriage further includes an upright 19 comprising a post of rectangular cross section. The upright includes a second post portion 20 with the lower ends of the upright 19 and post portion 20 being secured to a transverse bar 21 of the base 16 by suitable threaded means, such as nuts and bolts 22, so as to mount the upright 19 and post portion 20 on opposite sides of the bar 21.

Post portion 20 is provided with a handle 23 at its upper end for use in moving the wrapping apparatus about the pallet-carried load.

Apparatus 10 further includes a carrier generally designated 24 for carrying the roll 11 for rotation about the roll axis during the wrapping operation. Carrier 24 includes a bottom roll support 25 having a spindle 26 upstanding therefrom in parallel spaced relationship to the upright 19. Roll support 25 is provided with a collar 27 slidably carried on upright 19 and having a cutout portion 28 accommodating the bar 21 when the collar is in the lowermost disposition wherein the bottom roll support 25 is substantially at floor level.

To facilitate sliding movement of collar 27 on upright 19, the collar may be provided with a plurality of slide strips 29 engaging the surfaces of upright 19. As shown in FIG. 2, the upright is spaced from rear post portion 20 sufficiently to permit the collar to move freely therebetween between the lowermost position wherein the collar is at the lower end of upright 19 and an uppermost position wherein the collar is at the upper end 30 of upright 19.

A pair of washers 31 and 32 are provided on the lower end of spindle 26, the outer diameter of washer 31 being greater than the diameter of core 12 and the outer diameter of washer 32 being slightly smaller than the inner diameter of core 12 to be received therein and thereby guide the lower end of the roll 11 for rotation about the axis of spindle 26 during the withdrawal of the sheet S from the roll.

The upper end 33 of core 12 is supported for rotation on a collar portion 34 of an end cap 35 which is secured to the upper end 36 of spindle 26 by adjustable securing means 37.

As best seen in FIG. 2, securing means 37 includes a female threaded portion 38 in the upper end 36 of spindle 26. A threaded securing member 39 is provided with annular shoulder means generally designated 40 for engaging cap 35 as an incident of threaded movement of member 39 into threaded portion 38 of spindle end 36. The shoulder means includes a pair of washers 41 and 42 and a resilient ring 43 coaxially therebetween on the upper end of threaded member 39. A handle 44 is provided at the distal end of member 39 for threading member 39 into female threaded portion 38 to act through washer 42 and resilient ring 43 against washer 41 and thereby resiliently urge washer 41 against the cap 35.

Cap 35 defines a radial slot 45 permitting the cap to be installed outwardly of the outer upper end 36 of spindle 26 about the upper end of threaded member 39 below the washer 41. The slot 45 extends to the center of the cap so as to dispose the cap coaxially of the spindle 26 when so installed about the member 39. In such disposition, collar portion 34 of the cap is received within the core 12 of roll 11 so as to rotatably support the upper end of the roll during withdrawal of the sheet therefrom in the wrapping operation.

Tension on the roll is controlled by the adjustment of threaded member 39 in threaded portion 38 by suitably manipulating handle 44 to urge shoulder means 40 downwardly against cap 35 and, thus, against the core 12 of roll 11.

Cap 35 is retained in association with the upper end 36 of spindle 26 by a locking screw 46 having an unthreaded upper end adjustably threaded to a second internally threaded member 47 mounted to the side of spindle end 36, as seen in FIG. 2. Cap 35 is provided with a suitable opening 48 through which member 46 is passed in locking the cap to the spindle against lateral withdrawal therefrom.

When it is desired to remove a spent core from the spindle 26, the user merely unthreads member 39 to raise shoulder means 40 sufficiently to permit the cap 35 to be raised upwardly from the upper end of member 46, permitting the cap to be removed laterally from the end of the core 12. Handle 44 is constructed to permit the core to move coaxially thereabout, thereby eliminating the need to fully remove the securing means from the end 36 of spindle 26 in removing and replacing rolls on the spindle carrier.

As shown in FIG. 2, washer 31 is provided with a central opening 49 adapted to pass about threaded member 47 in moving downwardly from the upper end 36 of spindle 26 and washer 32 is provided with a similar opening 50 for this purpose.

Vertical positioning of the roll on support 19 is effected by raising the carrier 24 against the weight thereof and the roll thereon. In the illustrated embodiment, the raising of the carrier and roll is effected by a cable 51 connected to a drum 52 having a handle 53. The drum is rotatably mounted to a bracket 54 secured to the post portion 20 by suitable threaded means, such as nuts and bolts 55.

Cable 51 is trained over a pair of rollers 56 carried on a roller support 57 by a pair of roller pins 58 secured to the support by suitable nuts 59. The support is mounted to the upper end 30 of upright 19 and upper end 60 of post portion 20, and thus, guides cable 51 from drum 52 upwardly about the rollers 56 to a distal end 61 of the cable secured to bottom roll support 25 by a suitable connecting hook 62.

The invention comprehends that the mechanism for adjusting the vertical disposition of the roll on the upright 19 be disposed adjacent handle 23 for facilitated concurrent movement of the apparatus about the pallet-carried load and controlled vertical movement of the roll to effect the desired spiral wrapping of the load. Thus, illustratively, during the original pass of the apparatus about the lower portion of the load and pallet, the roll may be maintained at a constant level so as to provide a first horizontal wrap. Then, as the apparatus is again moved around the pallet-carried load, the roll may be progressively raised until the load is fully spirally wrapped to the top portion thereof, whereupon a final horizontal wrap may be effected with the roll being maintained at a constant elevated position, as desired.

In the illustrated embodiment, the means for raising the roll comprises mechanically operable means, it being obvious to those skilled in the art that suitable electrically operated or other forms of powered mechanism may be utilized within the scope of the invention.

As best seen in FIG. 2, the bottom roll support 25 comprises a flat plate which may be disposed substantially flush with the floor on which the pallet P is resting so as to permit the lower edge 13 of film sheet S to be disposed closely adjacent the floor in wrapping the pallet, thereby providing an improved wrapping of the pallet-carried load.

As the roll carrier is supported only by the bottom roll support 25 on upright 19, the roll may be brought to a high elevation for relatively high loads, while yet the total height of the upright is relatively small for facilitated manipulation and ease of wrapping operation.

The juxtaposition of handle 23 and lifting handle 53 provides for facilitated concurrent manipulation of the apparatus in effecting the desired wrapping operation.

The apparatus is extremely simple and economical of construction while yet providing improved wrapping operation and facilitated replacement of the wrapping sheet rolls.

The foregoing disclosure of specific embodiments is illustrative of the broad inventive concepts comprehended by the invention.

I claim:

1. Apparatus for wrapping a load on a floor-carried pallet comprising:

a carriage having a wheeled base for rolling movement of the carriage on the floor about the pallet-carried load, an upright upstanding from said base, and handle means for manipulation of the carriage in causing the rolling movement thereof;

a carrier for carrying a roll of sheet material on a core for rotation about the roll axis including a flat plate defining a bottom wall support, a spindle upstanding from said bottom roll support rotatably coaxially carrying said roll and having an upper outer end, threaded means coaxially on said outer end of the spindle, a threaded member coaxially threadedly mounted to said threaded means and having an annular shoulder means, a cap having a radial slot permitting said cap to be brought laterally about said member into a dispostion axially outwardly adjacent said spindle outer end with said shoulder means spaced axially outwardly thereof, and means for threading said member on said threaded means to urge said shoulder means axially inwardly and against said cap and retain said cap on said spindle to retain the sheet material roll coaxially on said spindle against movement outwardly from said outer end, wherein said means for threading said threaded member on said threaded means comprises a manipulating handle at its distal end of a size smaller than said core, about which member and handle the roll is coaxially passed during placement of a sheet material roll on, and during withdrawal of the sheet material roll from, the spindle upon removal of said cap and without removal of said member from said spindle; and moving means for moving the carrier vertically along the upright as the carriage is moved about the pallet-carried load between a lowermost position wherein the lower edge of sheet material roll on the carrier is disposed substantially at floor level adjacent the bottom of the pallet and an uppermost position wherein the top of the roll is at a position substantially above the top of the upright to permit the upper edge of sheet material withdrawn from said roll to be adjacent the top of the load on the pallet notwithstanding the disposition of the top of the load at an elevation substantially above that of the top of the upright to wrap the entire pallet and load thereon as desired, said moving means including manually operable means disposed adjacent said handle means for facilitated concurrent movement of the carriage about the pallet-carried load and movement of the carrier on the upright in effecting the spiral wrapping.

2. The wrapping apparatus of claim 1 wherein said moving means comprises means for positioning said bottom roll support plate substantially on the floor in said lowermost position of the carrier.

3. The wrapping apparatus of claim 1 wherein said carrier defines a collar slidably mounted to said upright and said moving means comprises means for sliding said collar upwardly along the upright against the weight of the carrier and sheet material roll thereon.

4. The wrapping apparatus of claim 1 wherein said carrier defines a collar slidably mounted to said upright and said moving means comprises cable means connected between said manually operable means and said collar for sliding said collar upwardly along the upright against the weight of the carrier and sheet material roll thereon.

5. The wrapping apparatus of claim 1 wherein said manually operable means comprises mechanically operable means.

6. The wrapping apparatus of claim 1 wherein said annular shoulder means comprises resiliently coaxially compressible means.

7. The wrapping apparatus of claim 1 wherein said annular shoulder means comprises resiliently coaxially compressible means including a pair of rigid collars and a resilient ring coaxially between said collars.

8. The wrapping apparatus of claim 1 further including locking means for selectively preventing lateral movement of said cap from said disposition outwardly adjacent said spindle outer end.

9. The wrapping apparatus of claim 1 further including locking means for selectively preventing lateral movement of said cap from said disposition outwardly adjacent said spindle outer end, said locking means comrpising second threaded means on said spindle outer end, and a second threaded member adjustably secured to said threaded means for retaining said cap against lateral movement.

10. The wrapping apparatus of claim 1 further including locking means for selectively preventing lateral movement of said cap from said disposition outwardly adjacent said spindle outer end, said locking means comprising second threaded means on said spindle outer end, and a second threaded spindle outer end, and a second threaded member having a portion engaging said cap when threaded to said threaded means to prevent said lateral movement, said second threaded means comprising an internally threaded tubular member mounted in side-by-side relationship to said spindle outer end.

* * * * *